US007303418B2

(12) United States Patent
O'Connor

(10) Patent No.: US 7,303,418 B2
(45) Date of Patent: Dec. 4, 2007

(54) COUPLER HOUSING ASSEMBLY FOR AN ELECTRICAL CONNECTOR

(75) Inventor: Douglas P. O'Connor, Richmond, RI (US)

(73) Assignee: Hubbell Incorporated, Orange, CT (US)

( * ) Notice: Subject to any disclaimer, the term of this patent is extended or adjusted under 35 U.S.C. 154(b) by 346 days.

(21) Appl. No.: 10/915,714

(22) Filed: Aug. 11, 2004

(65) Prior Publication Data

US 2006/0035509 A1 Feb. 16, 2006

(51) Int. Cl.
*H01R 13/52* (2006.01)

(52) U.S. Cl. ..... 439/277; 439/369

(58) Field of Classification Search ..... 439/369, 439/277

See application file for complete search history.

(56) References Cited

U.S. PATENT DOCUMENTS

| | | | | |
|---|---|---|---|---|
| 470,238 | A | 3/1892 | Goodman | |
| 1,979,304 | A | 11/1934 | Anderson | |
| 1,984,026 | A | 12/1934 | Little | |
| 3,281,755 | A | 10/1966 | Trager | |
| 3,455,805 | A * | 7/1969 | May et al. | 204/494 |
| 3,816,641 | A | 6/1974 | Iversen | |
| 5,299,951 | A | 4/1994 | Blaetz | |
| 6,390,847 | B2 * | 5/2002 | Katwala | 439/491 |
| 6,409,532 | B2 | 6/2002 | Payson | |
| 6,435,911 | B1 | 8/2002 | Payson | |
| 6,582,248 | B2 | 6/2003 | Bachman | |
| 6,595,791 | B2 | 7/2003 | Below | |
| 6,817,902 | B2 * | 11/2004 | Bernardi et al. | 439/676 |
| 2004/0038588 | A1 | 2/2004 | Bernardi | |

* cited by examiner

*Primary Examiner*—P. Austin Bradley
(74) *Attorney, Agent, or Firm*—Marcus R. Mickney; Mark S. Bicks; Alfred N. Goodman

(57) ABSTRACT

An electrical connector assembly includes a coupler housing and a coupler member secured to the coupler housing that receives a connector. The coupler housing has a first end and a second end. The coupler member is secured to the first end of the coupler housing. A cord connector is secured to the second end of the coupler housing. An electrical cord is electrically and mechanically coupled to the connector through the second end of the coupler housing. The electrical connector assembly provides a compact and portable electrical connector assembly that protects the housed connector from harsh conditions found in industrial and mechanical environments.

39 Claims, 5 Drawing Sheets

COUPLER HOUSING ASSEMBLY FOR AN ELECTRICAL CONNECTOR

FIELD OF THE INVENTION

The present invention relates to a coupler housing assembly that protects its internal components from harsh mechanical, electrical and environmental conditions. More particularly, the present invention relates to a coupler housing assembly that protects an internal telecommunications connector, such as a jack, from harsh mechanical, electrical and environmental conditions. Still more particularly, the present invention relates to a compact and portable harsh environment electrical connector having an unfixed coupler housing assembly adapted to mate to a corresponding plug assembly. The coupler housing assembly encapsulates the internal telecommunications connector to provide protection for the internal telecommunications connector and to the mating telecommunications connector upon engagement.

BACKGROUND OF THE INVENTION

Telecommunication systems continue to be used in new environments because of the increasing necessity for fast and efficient data access and transfer. Many of those environments subject the telecommunication systems to harsh conditions, such as exposure to water, dust, temperature changes and other foreign materials. Electrical connectors used in these telecommunication systems need to be able to protect the electrical connections from these harsh conditions. Invasion of an electrical connector by foreign matter can destroy the integrity of the electrical connection, thereby rendering the electrical connector and the telecommunication system inoperable. Such an event causes time delays and increased costs in the application in which the electrical connector is being used. Thus, a need exists for an electrical connector that prevents foreign materials from invading the electrical connector and associated components.

Industrial and manufacturing environments commonly use telecommunication systems to increase efficiency. Electrical connectors in such environments are frequently exposed to large amounts of foreign materials that are prevalent in those environments. Dust, water, chemicals and other foreign materials are much more difficult to contain and exist in larger quantities in those environments than in office environments. Therefore, industrial and manufacturing environments require electrical connectors to withstand frequent and large quantities of foreign materials. Furthermore, in industrial and manufacturing applications failure of the telecommunication system due to a damaged electrical connector may result in temporary downtimes, thereby resulting in inefficient industrial and manufacturing applications. Therefore, a need exists for an electrical connector that is protected from the large quantities of potentially damaging foreign materials that are prevalent in certain environments.

Electrical connectors used in industrial and manufacturing environments often need to be compact and portable for the wide variety of applications in which they are used. Additionally, such electrical connectors need to be able to withstand the harsh conditions found in the industrial and manufacturing environments in which the electrical connectors are used. Therefore, a need exists for an electrical connector that is compact and portable, and able to protect the components of the electrical connector from the harsh conditions present in such environments.

SUMMARY OF THE INVENTION

Accordingly, a primary objective of the present invention is to provide an improved electrical connector.

Another objective of the present invention is to provide an improved coupler housing assembly to encapsulate a jack housing in an electrical connector for use in telecommunications systems.

Another objective of the present invention is to provide an improved coupler housing assembly that protects a jack from harsh mechanical, electrical and environmental requirements while providing a compact and portable assembly.

Yet another objective of the present invention is to provide an improved electrical connector that protects the electrical connector and associated components from the large quantities of foreign materials that are prevalent in particular environments in which the electrical connector is used.

The foregoing objects are basically attained by providing an electrical connector assembly including a connector, a coupler member that receives the connector, and a coupler housing secured to the coupler member. The coupler housing has a first end and a second end. The coupler member is secured to the first end of the coupler housing. A cord connector is secured to the second end of the coupler housing. An electrical cord is electrically and mechanically coupled to the connector through the second end of the coupler housing. The electrical connector assembly provides a compact and portable electrical connector assembly that protects the housed connector from harsh conditions found in industrial and mechanical environments.

Other objects, advantages and salient features of the invention will become apparent from the following detailed description, which, taken in conjunction with the annexed drawings, discloses a preferred embodiment of this invention.

BRIEF DESCRIPTION OF THE DRAWINGS

Referring now to the drawings that form a part of the original disclosure.

DETAILED DESCRIPTION OF THE INVENTION

Figure 1:
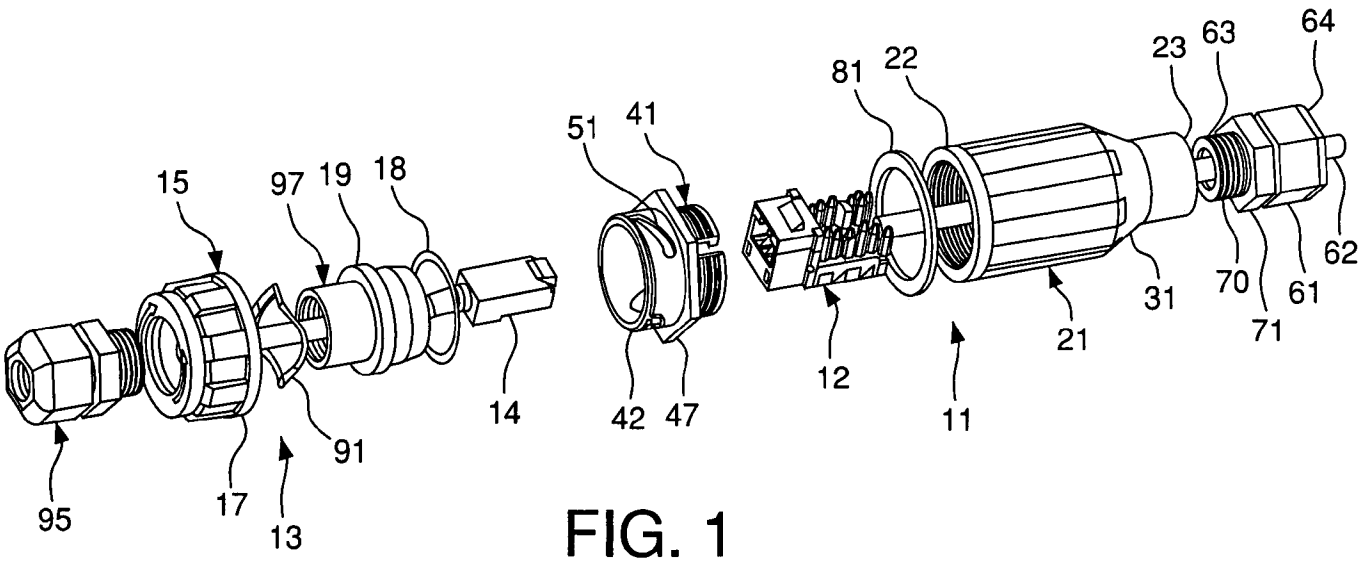
FIG. 1 is an exploded perspective view of an electrical connector assembly according to the present invention.

As shown in FIGS. 1-16, the present invention relates to an electrical connector assembly 11 that protects the connector 12 and its associated internal components from harsh mechanical, electrical and environmental requirements. An electrical connector assembly 11 includes a coupler housing 21 that receives a connector 12. The coupler housing 21 has a first end 22 and a second end 23. A coupler member 41 is secured to the first end 22 of the coupler housing 21. A cord connector 61 is secured to the second end 23 of the coupler housing 21. An electrical cord 62 is electrically and mechanically coupled to the connector 12 through the second end 23 of the coupler housing 21. The electrical connector assembly 11 provides a compact and portable electrical connector assembly that protects the housed connector from harsh conditions found in industrial and mechanical environments.

Figure 2:
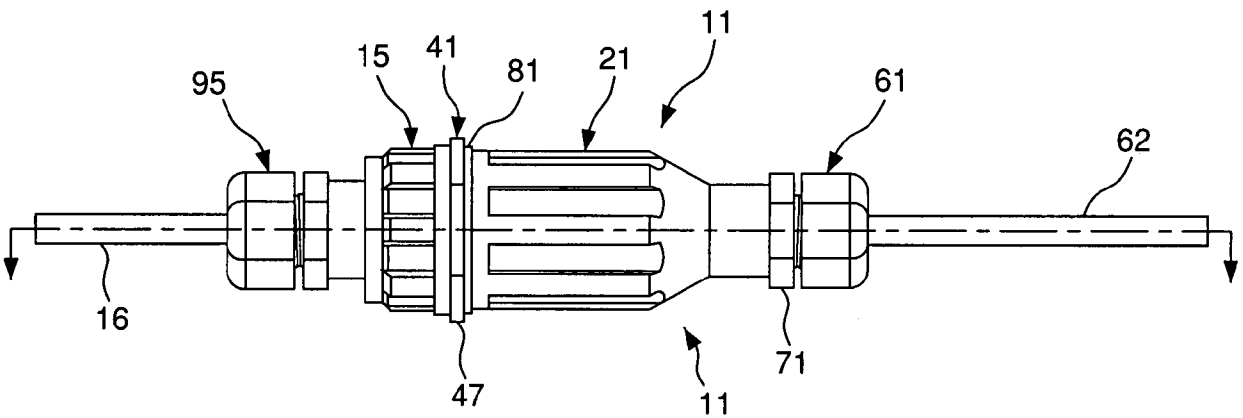
FIG. 2 is a side elevational view of the electrical connector assembly of FIG. 1.
Figure 3:
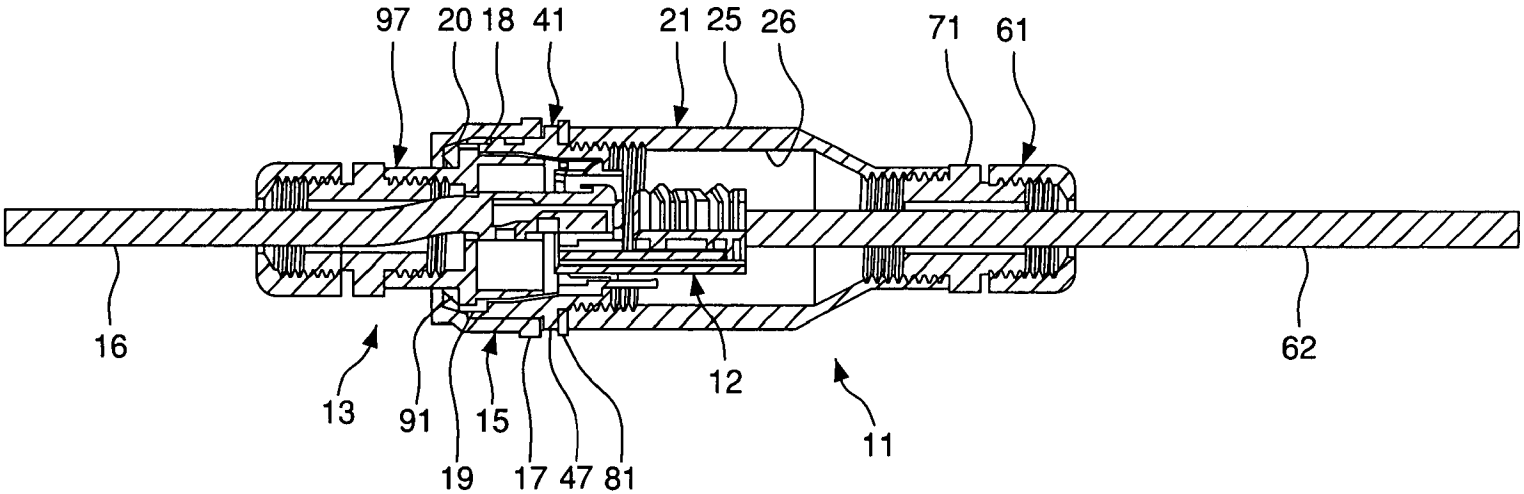
FIG. 3 is a side elevational view in cross section of the electrical connector assembly of FIG. 2.
Figure 4:
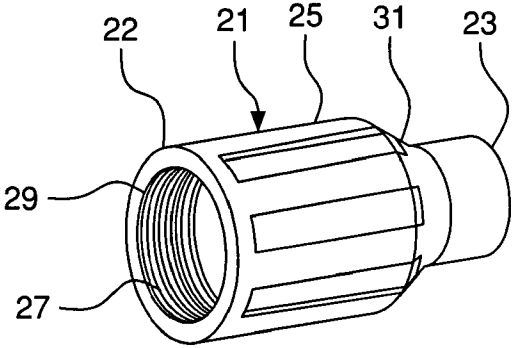
FIG. 4 is a perspective view of a coupler housing assembly of FIG. 1.
Figure 5:
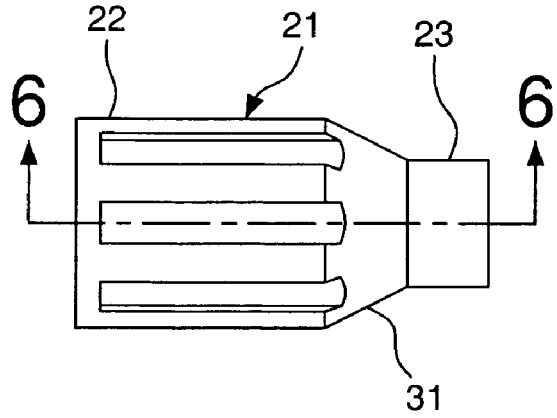
FIG. 5 is a side elevational view of the coupler housing assembly of FIG. 4.
Figure 6:
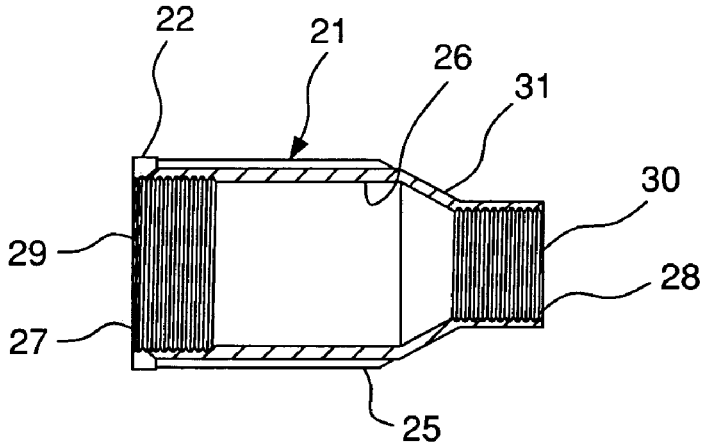
FIG. 6 is a side elevational view in cross section of the coupler housing assembly of FIG. 5.
Figure 7:
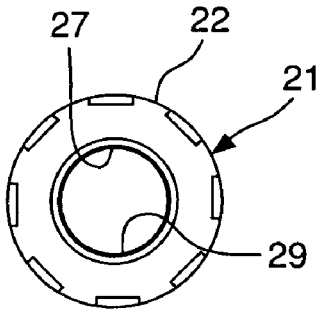
FIG. 7 is a front elevational view of the coupler housing assembly of FIG. 4.
Figure 8:
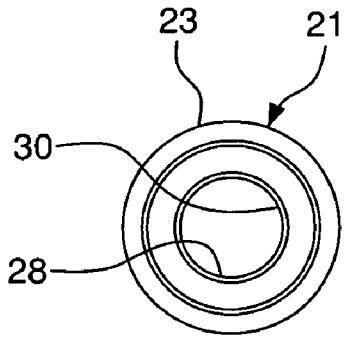
FIG. 8 is a rear elevational view of the coupler housing assembly of FIG. 4.
Figure 9:
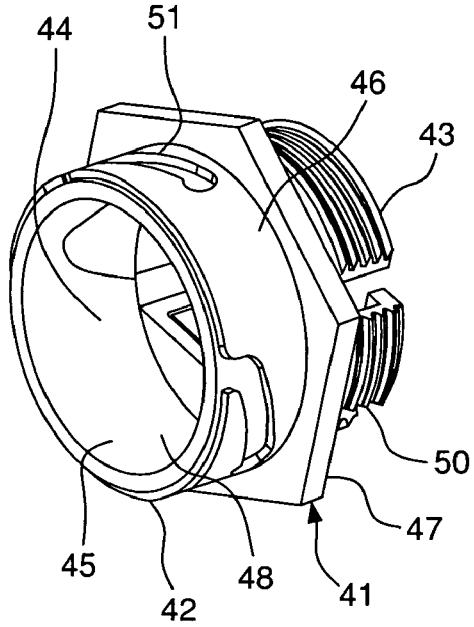
FIG. 9 is a perspective view of a connector housing assembly of FIG. 1.
Figure 10:
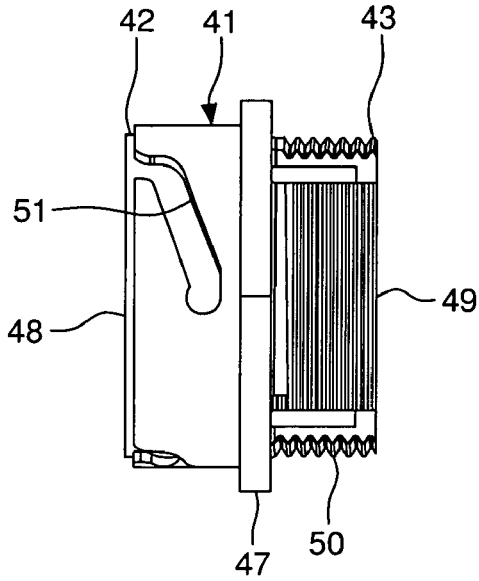
FIG. 10 is a side elevational view of the connector housing assembly of FIG. 9.
Figure 11:
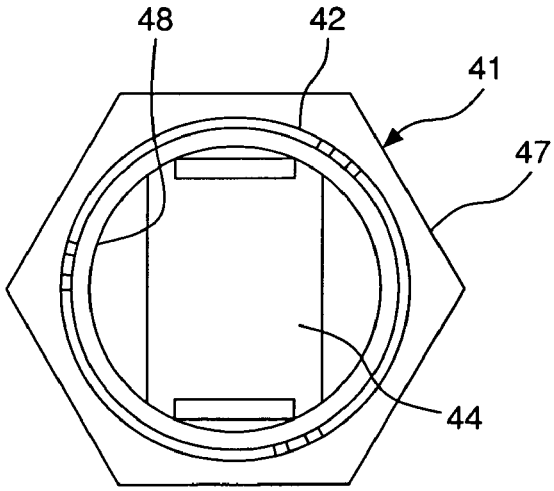
FIG. 11 is a front elevational view of the connector housing assembly of FIG. 9.
Figure 12:
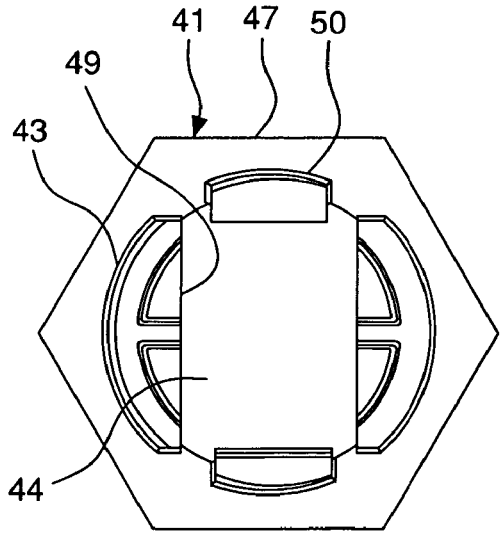
FIG. 12 is a rear elevational view of the connector housing assembly of FIG. 9.
Figure 13:
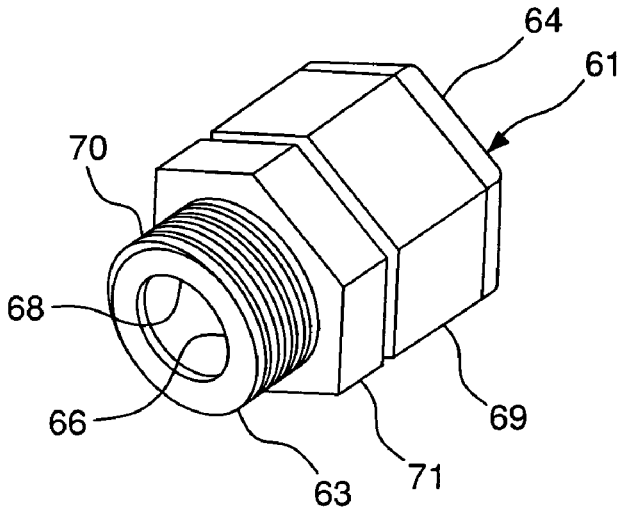
FIG. 13 is a perspective view of the cord connector assembly of FIG. 1.
Figure 14:
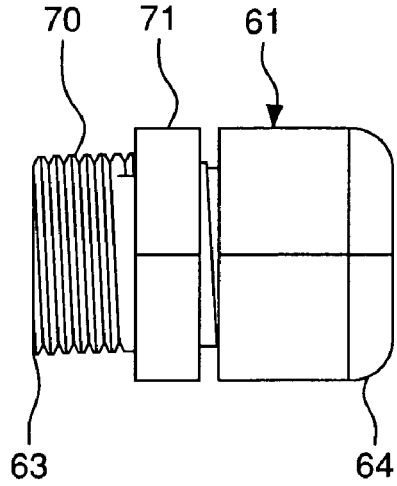
FIG. 14 is a side elevational view of the cord connector assembly of FIG. 13.
Figure 15:
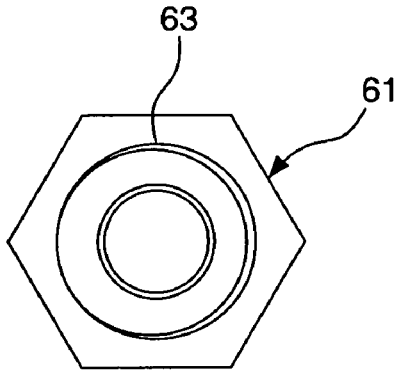
FIG. 15 is a front elevational view of the cord connector assembly of FIG. 13.
Figure 16:
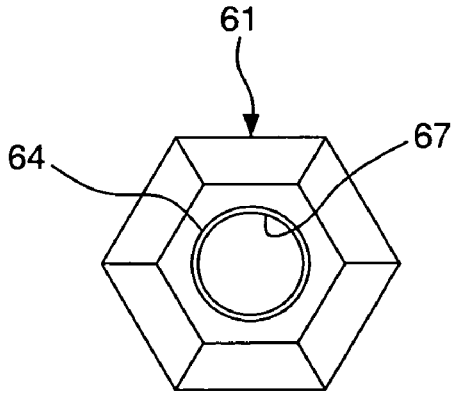
FIG. 16 is a rear elevational view of the cord connector assembly of FIG. 13.

The coupler housing 21, as shown in FIGS. 4-8, receives a connector 12. Preferably, the connector 12 is a jack, such as an RJ-45 jack, but any suitable connector may be received by the coupler housing 21. The coupler housing 21 has an outer surface 25 and an inner surface 26. A first passageway 24 extends from a first opening 29 at a first end 22 of the coupler housing 21 to a second opening 30 at a second end 23 to form the inner surface 26. The inner surface 26 of the coupler housing 21 is adapted to securely receive the connector 12, as shown in FIG. 3. The inner surface 26 at the first end 22 preferably has threads 27 to receive the coupler member 41, as shown in FIGS. 2 and 3. The inner surface 26 at the second end 23 of the coupler housing 21 preferably has threads 28 to receive the cord connector 61. Preferably, the diameter of the first opening 29 is larger than the diameter of the second opening 30, and a portion 31 of coupler housing 21 tapers inwardly between the first and second ends 22 and 23. Any suitable material may be used to make the coupler housing, such as a thermoplastic or metal.

A coupler member 41 has a first end 42 and a second end 43, as shown in FIGS. 9-12. A second passageway 44 extends from a first opening 48 at the first end 42 of the coupler member 41 to a second opening 49 at the second end 43 and forms an inner surface 45 of the coupler member 41. A shoulder 47 extends outwardly from an outer surface 46 of the coupler member 41. A portion of the outer surface 46 between the shoulder 47 and the first end 42 of the coupler member 41 has at least one groove 51 adapted to mate with a corresponding electrical connector 13, as shown in FIGS. 1-3. Preferably, the at least one groove 51 provides a bayonet connection with the corresponding electrical connector 13. A portion of the outer surface 46 between the shoulder 47 and the second end 43 of the coupler member 41 has threads 50 adapted to receive the threaded portion 27 of the coupler housing 21. Any suitable material may be used to make the coupler member, such as a plastic, including thermoplastic polyester resins.

A sealing member 81 is disposed on the outer surface 46 of the coupler member 41 rearward of the shoulder 47, as shown in FIGS. 1-3. Preferably, the sealing member 81 is a gasket or O-ring. When the coupler member 41 and coupler housing 21 are engaged, the sealing member 81 abuts the shoulder 47 on one side and abuts the front end 22 of the coupler housing, as shown in FIGS. 2 and 3.

The cord connector 61, as shown in FIGS. 13-16, has a first opening 66 at a first end 63 and a second opening 67 at a second end 64. An inner surface 68 is formed by a third passageway 65 extending between the first and second openings 66 and 67. The outer surface 69 at the first end 63 preferably has threads 70 to facilitate mating with the second end 23 of the coupler housing 21. A nut 71 is disposed on the outer surface 69 of the cord connector and rearward of the threads 70. The cord connector seals an electrical cord 62 therein, as well as providing strain relief for the electrical cable in the electrical connector assembly 11. Preferably, the diameter of the second opening 67 is larger than the diameter of the first opening 66 to allow bending of the cord 62, thereby providing strain relief to the cord. Preferably, the first opening 66 provides an interference fit with the electrical cord 62 to secure the cord within the connector 61. Cord connectors 61 are conventional and readily available. Cord connectors may be made of any suitable material, including plastics such as nylon.

The corresponding second electrical connector assembly 13 includes a second connector 14 adapted to mate with the connector 12 of the electrical connector assembly 11, as shown in FIGS. 1 and 3. A coupling nut 15 of the second electrical connector assembly 13 has protrusions to engage the grooves 51 of the coupler member 41 to secure the second electrical connector assembly to the first electrical connector assembly 11 through a bayonet connection. A second cord connector 95 is secured to the coupling nut 15 to facilitate securing a second electrical cable 16 to the second electrical connector assembly 13, and to provide strain relief for the second electrical cable in the assembly. Engaging the protrusions of the coupling nut 15 with the grooves 51 of the coupler member 41 provides a mechanical and electrical connection between first electrical cable 62 and second electrical cable 16.

Assembly and Disassembly

An exploded view of the electrical connector assembly 11 of the present invention and a corresponding second electrical connector assembly 13 is shown in FIG. 1. As shown in FIGS. 2 and 3, the electrical connector assembly 11 of the present invention is fully assembled. As shown in FIGS. 2 and 3, the electrical connector assembly 11 is mated with the corresponding second electrical connector assembly 13.

A cable 62, or any other suitable structure capable of data transfer, is connected to the cord connector 61. A free end of the cable 62 is connected to the jack 12, which is preferably an RJ-45 jack. The other end of the cable 62 is passed rearwardly through the first passageway 24 of the coupler housing 21 and the third passageway 65 of the cord connector 61. Preferably, the first opening 66 of the cord connector 61 provides an interference fit with the cable 61 to secure the cable within the electrical connector assembly 11. The jack 12 is inserted into the second passageway 44 through the second opening 49 in the coupler member 41, where the jack is securely received, as shown in FIG. 3. Once the jack 12 has been inserted in the coupler member 41, the first sealing member 81 is disposed on the outer surface 46 rearward of the shoulder 47.

The coupler housing 21 is then threadably connected to the coupler member 41, as shown in FIG. 3. The threads 27 at the first end 22 of the coupler housing 21 threadably engage the threads 50 at the second end 43 of the coupler member 41. The sealing member 81 is compressed between the shoulder 47 of the coupler member 41 and the front end 22 of the coupler housing 21, thereby sealing the connection between the coupler member and the coupler housing. The jack 12 is substantially entirely encapsulated within the coupler member 41 and coupler housing 21.

The cord connector 61 is then threaded connected to the coupler housing 21. The threads 70 at the first end 63 of the cord connector 61 threadably engage the threads 28 at the second end 23 of the coupler housing 21. The cord connector 61 is threaded into the second end 23 of the coupler housing 21 until the nut 71 engages the second end of the coupler housing, as shown in FIGS. 2 and 3.

As shown in FIGS. 2 and 3, the assembled electrical connector assembly 11 provides a compact and portable electrical connector assembly that protects its internal components from external conditions.

The electrical connector assembly 11 is engageable with a corresponding electrical connector assembly 13, as shown in FIGS. 1-3, and described in further detail in U.S. patent application Ser. No. 10/753,949, which is hereby incorporated by reference in its entirety. The plug 14, preferably an RJ-45 plug, is secured within a plug housing 97, as shown in FIG. 3. The plug 14 is then inserted into the electrical connector assembly 11 to mate the jack and plug. A second seal member 18 is positioned between a shoulder 19 of the plug housing 97 and the front end 42 of the coupler member 41, thereby effectively sealing the plug housing and coupler member together. A second cord connector 95, preferably substantially similar to cord connector 61, secures the second electrical cable 16 in the second electrical connector 13, and provides strain relief for the second electrical cable. The coupling nut 15 is then slid forward over the plug housing 97 until a rear wall 20 of the coupling nut is proximal the shoulder 19 of the plug housing. As the coupling nut 15 is mated with the coupler member 41, preferably by a bayonet connection, the rear wall 20 of the coupling member compresses a spring 91 against the shoulder 19 of the plug housing 97. The coupling nut 15 slides over the coupler member 41, and has protrusions on an inner surface at the first end 17 to engage the at least one grooves 51 at the first end 42 of the coupler member, thereby electrically and mechanically connecting the electrical connector assemblies 11 and 13 to allow transfer between the electrical cables 62 and 16.

While one advantageous embodiment has been chosen to illustrate the invention, it will be understood by those skilled in the art that various changes and modifications may be made therein without departing from the scope of the invention as defined in the appended claims.

What is claimed is:

1. An electrical connector assembly, comprising:

a connector;

a coupler housing having a first end and a second end;

a coupler member receiving said connector and secured to said first end of said coupler housing;

a sealing member disposed on said coupler member and abutting said first end of said coupler housing;

a cord connector secured to said second end of said coupler housing; and an electrical cord coupled to said connector through said second end of said coupler housing.

2. An electrical connector assembly according to claim 1, wherein said connector is a jack.

3. An electrical connector assembly according to claim 1, wherein said connector is an RJ-45 jack.

4. An electrical connector assembly according to claim 1, wherein said sealing member abuts a shoulder on said sealing member.

5. An electrical connector assembly according to claim 1, wherein a portion of said coupler housing tapers inwardly between said first end and said second end of said coupler housing.

6. An electrical connector assembly according to claim 1, wherein said connector is substantially entirely encapsulated by said coupler housing and said coupler member.

7. An electrical connector assembly according to claim 1, wherein said sealing member is a gasket.

8. An electrical connector assembly according to claim 1, wherein said coupler housing is internally threaded at said first end.

9. An electrical connector assembly according to claim 8, wherein said coupler member is externally threaded at a second end to engage said internal threads at said first end of said coupler housing.

10. An electrical connector assembly according to claim 1, wherein said coupler housing is internally threaded at said second end.

11. An electrical connector assembly according to claim 10, wherein said cord connector is externally threaded at a first end to engage said internal threads at said second end of said coupler housing.

12. An electrical connector assembly according to claim 1, wherein a first opening at said first end has a first diameter and a second opening at said second end has a second diameter.

13. An electrical connector assembly according to claim 12, wherein said first diameter is larger than said second diameter.

14. An electrical connector assembly according to claim 1, wherein said coupler member has first and second ends, said second end being secured to said coupler housing and said first end being adapted to receive a mating electrical connector.

15. An electrical connector assembly according to claim 14, wherein said first end of said coupler member has a bayonet connection adapted to receive a corresponding mating electrical connector.

16. An electrical connector assembly according to claim 15, wherein a coupling nut having protrusions is engageable with said bayonet connection of said coupler member.

17. An electrical connector assembly according to claim 16, wherein a connector housing is secured to said coupling nut, said mating electrical connector being housed within said connector housing.

18. An electrical connector assembly, comprising:

a connector;

a coupler housing having a first opening at a first end and a second opening at a second end, and a portion of said coupler housing tapering inwardly between said first and second ends;

a coupler member receiving said connector and secured to said first end of said coupler housing, said coupler member and coupler housing substantially entirely encapsulating said connector;

a sealing member disposed on an outer surface of said coupler member and abutting said first end of said coupler housing when engaged;

a cord connector secured to said second end of said coupler housing; and an electrical cord coupled to said connector through said second end of said coupler housing.

19. An electrical connector assembly according to claim 18, wherein said connector is a jack.

20. An electrical connector assembly according to claim 18, wherein said connector is an RJ-45 jack.

21. An electrical connector assembly according to claim 18, wherein said.

22. An electrical connector assembly according to claim 18, wherein said sealing member is a gasket.

23. An electrical connector assembly according to claim 18, wherein said coupler housing is internally threaded at said first end.

24. An electrical connector assembly according to claim 23, wherein said coupler member is externally threaded at a second end to engage said internal threads at said first end of said coupler housing.

25. An electrical connector assembly according to claim 18, wherein said coupler housing is internally threaded at said second end.

26. An electrical connector assembly according to claim 25, wherein said cord connector is externally threaded at a first end to engage said internal threads at said second end of said coupler housing.

27. An electrical connector assembly according to claim 18, wherein said first opening has a first diameter and said second opening has a second diameter.

28. An electrical connector assembly according to claim 27, wherein said first diameter is larger than said second diameter.

29. An electrical connector assembly according to claim 18, wherein said coupler member has first and second ends, said second end being secured to said coupler housing and said first end being adapted to receive a mating electrical connector.

30. An electrical connector assembly according to claim 29, wherein said first end of said coupler member has a bayonet connection adapted to receive a corresponding mating electrical connector.

31. An electrical connector assembly according to claim 30, wherein a coupling nut having protrusions is engageable with said bayonet connection of said coupler member.

32. An electrical connector assembly according to claim 31, wherein a connector housing is secured to said coupling nut, said mating electrical connector being housed within said connector housing.

33. An electrical connector assembly, comprising:

a connector;

a coupler housing having a first opening at a first end and a second opening at a second end, said first and second ends being internally threaded;

a coupler member receiving said connector and having first and second ends and a shoulder extending outwardly from an outer surface of said coupler member, said second end of said coupler member being externally threaded from said shoulder to said second end and secured to said first end of said coupler housing, said first end of said coupler housing being adapted to mate with a corresponding electrical connector, said coupler member and coupler housing substantially entirely encapsulating said connector when engaged;

a sealing member disposed on an outer surface of said coupler member and positioned between said shoulder of said coupler member and said first end of said coupler housing when said coupler housing and said coupler member are engaged;

a cord connector being externally threaded at a first end and secured to said second end of said coupler housing; and an electrical cord coupled to said connector through said second end of said coupler housing.

34. An electrical connector assembly according to claim 33, wherein said connector is a jack.

35. An electrical connector assembly according to claim 33, wherein said connector is an RJ-45 jack.

36. An electrical connector assembly according to claim 33, wherein said sealing member is a gasket.

37. An electrical connector assembly according to claim 34, wherein said first end of said coupler member has a bayonet connection adapted to receive the corresponding mating electrical connector.

38. An electrical connector assembly according to claim 33, wherein said first opening has a first diameter and said second opening has a second diameter.

39. An electrical connector assembly according to claim 38, wherein said first diameter is larger than said second diameter.

* * * * *